United States Patent [19]

Yescheskel et al.

[11] Patent Number: 4,888,856

[45] Date of Patent: Dec. 26, 1989

[54] TREATMENT OF COTTON

[75] Inventors: Herzel B. Yescheskel, Bat Yam; Gad Alon, Herzlia; Eliezer Beck, Rishon Lezion, all of Israel

[73] Assignee: The Shenkar College of Textile Technology and Fashion, Ramat Gan, Israel

[21] Appl. No.: 132,790

[22] Filed: Dec. 10, 1987

Related U.S. Application Data

[62] Division of Ser. No. 833,987, Feb. 26, 1986, Pat. No. 4,796,334.

[30] Foreign Application Priority Data

Feb. 28, 1985 [IL] Israel ..... 74469

[51] Int. Cl.[4] ..... D01B 1/48

[52] U.S. Cl. ..... 19/0.27; 19/66 CC

[58] Field of Search ..... 19/0.27, 66 CC

[56] References Cited

U.S. PATENT DOCUMENTS

| | | | |
|---|---|---|---|
| 4,535,510 | 8/1985 | Shoham | 19/0.27 |

FOREIGN PATENT DOCUMENTS

| | | | |
|---|---|---|---|
| 175338 | 3/1905 | Fed. Rep. of Germany | 19/112 |
| 1133286 | 7/1962 | Fed. Rep. of Germany | 19/236 |
| 2384041 | 10/1978 | France | 19/105 |
| 703033 | 5/1974 | U.S.S.R. | 19/0.27 |
| 1032299 | 7/1983 | U.S.S.R. | 19/0.27 |
| 433091 | 8/1935 | United Kingdom | 19/115 |

OTHER PUBLICATIONS

Publication by O. Elsner, entitled "Der Nachweis von Zuckerablagerungen auf Baumwolle", published in Textil Betrieb, Dec. issue 1982, pp. 22 to 24;

Publication by H. Khalifa, entitled "Ueber das Verkleben von Baumwolle", published in Internationales-Bulletin, Welt Ausgabe Spinnerei, Vol. 2, 1980, pp. 203 to 206.

Publication by H. Khalifa, entitled "Die Streuung des Hönigtaubefalls von Baumwoole im Hinblick auf die Probennahme", Published in Textil Praxis International, Nov. issue 1983, pp. 1187 to 1189; and Publication by S. M. Milnera, entitled Zur Analytik von Honigtau auf Rohbaumwolle, in Textil Betrieb, Dec. issue 1983, pp. 15 to 18 and 21.

*Primary Examiner*—Werner H. Schroeder
*Assistant Examiner*—D. Price
*Attorney, Agent, or Firm*—Werner W. Kleeman

[57] ABSTRACT

The invention relates to a process for rendering harmless sticky material adhering to cotton or cotton fibers, termed "honeydew". According to the process the cotton or cotton fibers is heated for a brief period of time to a temperature adequate to render said honeydew hard and brittle, and this without adversely affecting the cotton or cotton fibers. There are also provided means for effecting such treatment of the cotton fibers in a continuous manner.

22 Claims, 6 Drawing Sheets

1,888,856

TREATMENT OF COTTON

CROSS-REFERENCES TO RELATED APPLICATIONS

This application is a divisional application to the commonly assigned, copending United States Application Ser. No. 06/833,987, filed Feb. 26, 1986, entitled "TREATMENT OF COTTON", now U.S. Pat. No. 4,796,334; this application is related also to the commonly assigned, copending U.S. application Ser. No. 07/207,252, filed June 15, 1988, entitled "TREATMENT OF COTTON", and which application is a continuation application to the aforementioned parent application, namely U.S. application No. 06/833,987.

BACKGROUND OF THE INVENTION

The present invention relates to a new and improved method of processing cotton.

Sticky contaminants, resulting from a variety of insects, and especially from the white fly (Bamessia), for instance, are frequently present on cotton when this is picked. Such contaminants, generally referred to as "honeydew" renders the cotton or cotton fibers sticky, and this causes severe problems, especially during the drawing of cotton slivers: as these pass through the conventional pairs of rollers, the honeydew causes adhesion to these rollers, further cotton fibers become attached and the end-result is a work stoppage and the necessity to clean the rollers. This results in a lack of uniformity of the slivers and yarns which are produced, in serious time losses and increase of production costs with a reduction in the quality of the product.

It is known, for example, from a publication by 0. Elsner, entitled "Der Nachweis von Zuckerablagerungen auf Baumwolle"(The detection of carbohydrate deposits on cotton), published in the journal "Textilbetrieb" in the issue of December 1982, pages 22 through 24, that honeydew containing cotton, when heated in laboratory tests in a stationary manner at 130° C. for about 2 hours, becomes discolored due to honeydew caramelization and assumes a yellow to yellowish brown color.

Although the quantity of such honeydew quantified by the content of reducing sugars contained therein, is generally quite low (of the order of 0.1 to 1.5 per cent by weight), it causes serious problems during the various steps of the processing of cotton or cotton fiber, and especially during a spinning process. The present invention overcomes to a large extent the problems caused by such adhesive substances and renders them harmless.

The contamination of cotton with honeydew or the like causes serious problems in the processing of cotton or cotton fibers at various stages of the processing of such cotton or cotton fibers.

It is clear that the inventive method is applicable at any of the stages of the processing of the cotton or cotton fibers, and an early stage is of course advantageous.

Serious problems are generally encountered with such contaminated cotton or cotton fibers, particularly during the processing of cotton slivers on a draw frame. For the spinning process of cotton, a web is formed on a carding machine. Separation of fiber tufts into individual fibers and forming the web are done on a revolving flat card, which is a particular type of carding machine. After leaving the card, the web is pulled through a funnel-shaped hole and thus there is formed a so-called card sliver. To produce a yarn, the sliver has to be attenuated, possibly combed and finally twisted. Six to eight slivers are fed to a draw frame, and these are drawn into one, and this operation is accompanied by attenuation or drafting.

SUMMARY OF THE INVENTION

Therefore with the foregoing in mind it is a primary object of the present invention to provide a new and improved method of processing cotton and which method permits at least partially eliminating the problems which are caused by the presence of sticky materials like honeydew and the like at the cotton.

Another and more specific object of the present invention is directed to providing a new and improved method of processing cotton and which method permits at least partially removing sticky materials such as honeydew and the like from the cotton.

A further significant object of the present invention is directed to a new and improved method of processing cotton, and which method permits at least partially removing sticky materials like honeydew and the like, and can be readily integrated into existing processes for processing cotton.

Another, still important object of the present invention relates to a new and improved method of processing cotton and which method permits at least partially removing sticky materials like honeydew and the like, and is capable of being integrated at an early stage into existing processes for processing cotton.

Still another significant object of the present invention is directed to the provision of a new and improved method of processing cotton, and which method permits at least partially removing sticky materials like honeydew and the like, and can be carried out in a continuous manner.

Yet, a further significant object of the present invention aims at providing a new and improved method of processing cotton and which method permits at least partially removing sticky materials like honeydew and the like, and is carried out in a relatively simple and extremely economical manner, is highly reliable, not readily subject to breakdown or malfunction and requires a minimum of maintenance and servicing operations.

Now in order to implement these and still further objects of the invention, which will become more readily apparent as the description proceeds, the method of the present development is manifested, among other things, by the features that, cotton is exposed to a heat source having a predetermined temperature and is heated to a preselected maximum temperature during exposure to such heat source. The cotton is exposed to the heat source for a predetermined period of time sufficient for transforming sticky material such as honeydew and the like which is adhered to the cotton, to a hard and brittle, readily removable material.

It has been discovered that by subjecting cotton or cotton fibers to a controlled heating process preferably to a maximum of about 140° C. during a controlled period of time of a maximum of 10 seconds, and advantageously up to about 5 seconds with cotton slivers, honeydew droplets and the like can be rendered brittle and hard losing their adhesive properties without adversely affecting the cotton quality. The heating may be effected at any step of the entire process for processing cotton, but preferably before the drawing of the cotton slivers on the draw frame, as at this stage the most serious problems occur.

A further step of the inventive method may comprise separating the brittle drops from the cotton or cotton fibers.

There are provided simple devices, e.g. comprising a number of rotatory rollers, the surface temperature of which is maintained at a predetermined value, means being provided for passing the cotton sliver over such heated rollers so as to maintain contact for an adequate period of time to convert the sticky material to hard and brittle particles.

The heating process can be effected at any stage of the processing of cotton fibers. It has been found that when the cotton or cotton fibers is heated so as to reach a temperature of about 70° to 140° C., and maintained at such temperature for an adequate period of time, adhering honeydew droplets are converted to hard and brittle particles. The overall heating time of the cotton or cotton fibers is about ½ to about 5 seconds for cotton slivers and up to 10 seconds for cotton bales (upper surface), and such heating substantially reduces the stickiness of the fibers or eliminates it altogether.

BRIEF DESCRIPTION OF THE DRAWINGS

The invention will be understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
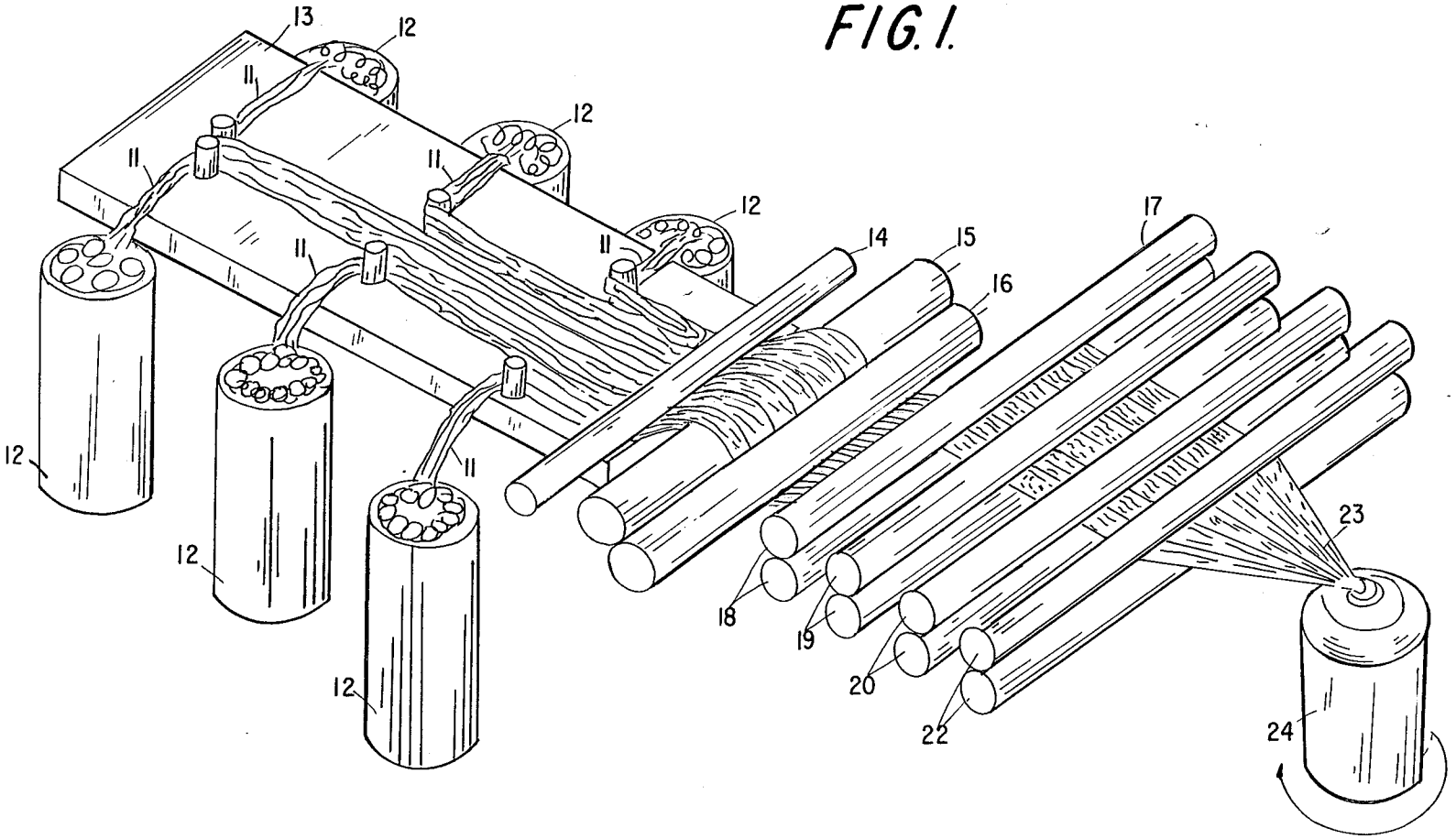
FIG. 1 is a perspective view of a device used in combination with a conventional drawing frame for carrying out a first exemplary embodiment of the inventive method for processing cotton fiber slivers.
Figure 2:
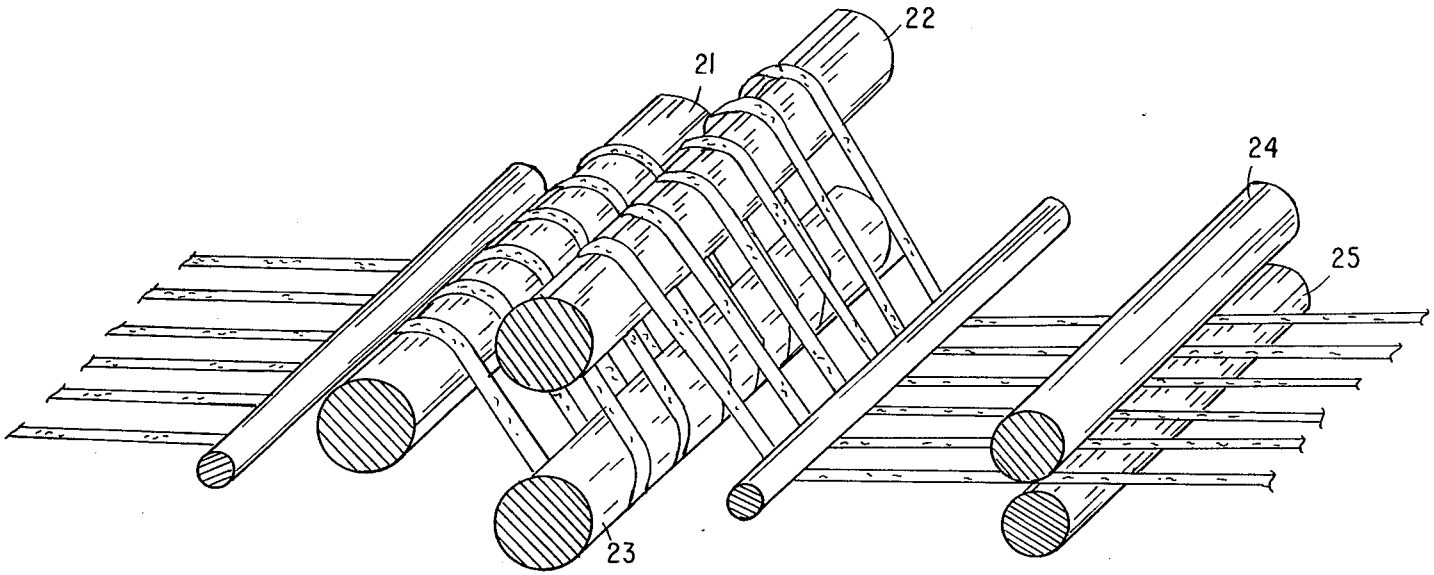
FIG. 2 is a perspective side-view of part of a device of the type as shown in FIG. 1 and containing three heated rollers.

Describing now the drawings, it is to be understood that only enough of the construction of a cotton processing device has been shown as needed for those skilled in the art to readily understand the method of treating cotton and the underlying principles and concepts of the present development, while simplifying the showing of the drawings. Turning attention now specifically to FIG. 1 of the drawings, the device illustrated therein by way of example and not limitation will be seen to comprise a device for processing cotton, and containing, for example, the conventional draw frame 17. Precedingly of the conventional draw frame 17, there are arranged six cans 12. Cotton slivers 11 are drawn from the six cans 12 and over a flat surface 13 under a roller 14, through heatable rotatory rollers 15 and 16, and from these to the conventional draw frame 17. The conventional draw frame 17 comprises 4 roller pairs 18, 19, 20 and 22, from which the resulting cotton sliver 23 is drawn into the container 24.

The rollers 15 and 16 are provided with internal electrical heating means which are provided with heat control means, so that the surface temperature of the rollers 15 and 16 can be adjusted to any predetermined value. Various experiments have shown that generally surface temperatures of from about 150° C. and to about 230° C. are satisfactory. When carrying out a first exemplary embodiment of the inventive method, the cotton slivers 11 are pressed or passed over the said rollers 15 and 16 at a speed of about 30 m/min (or 50 cm/sec). The cotton slivers 11 tested were 4 g/m sticky cotton, contaminated with considerable quantities of honeydew. The contact length of the cotton slivers 11 with the rollers was a total of about 55 cm and the cotton slivers 11 were heated during this period of time in such manner that it reached a temperature of about 75° C. The heating to this temperature for the contact time indicated, was adequate to render the adhesive droplets hard and brittle. When the conventional device was used without this attachment, the cotton slivers stuck to the roller pairs and caused serious problems.

When the rollers 15 and 16 are heated to a higher temperature, the time of contact can be decreased.

Figure 3:
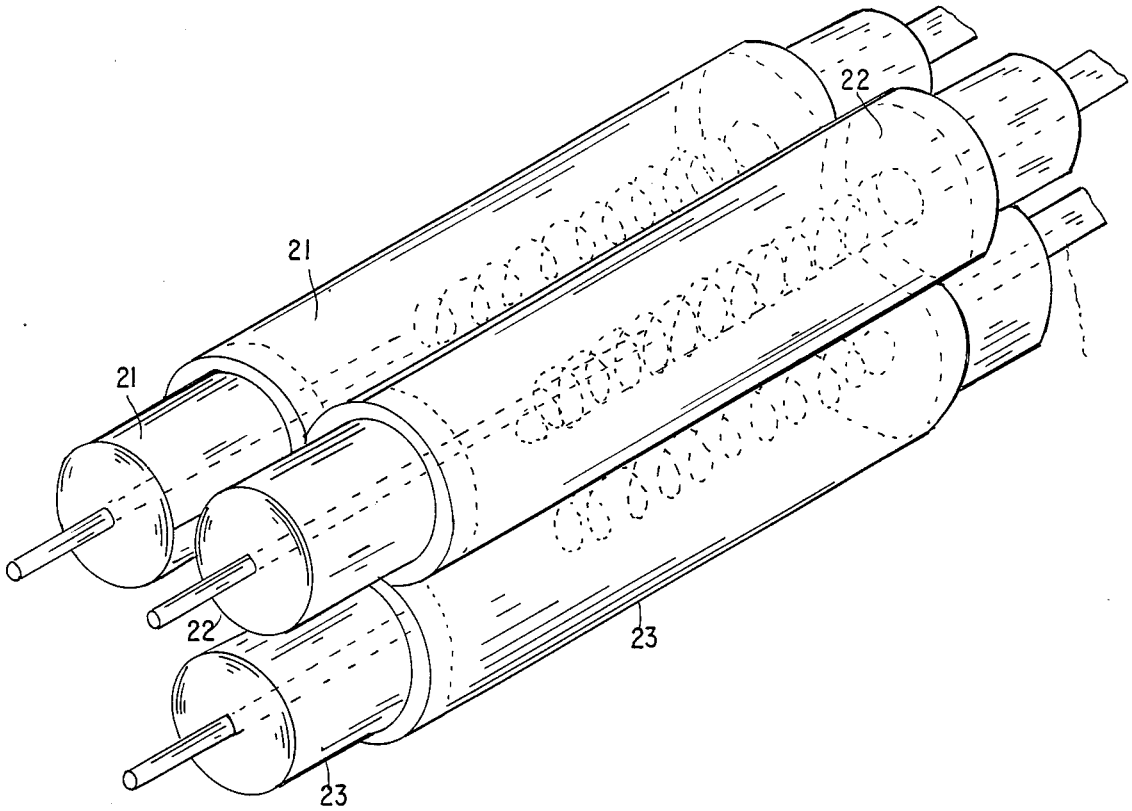
FIG. 3 is a perspective view of three heatable rollers and illustrates exemplary details of the heating means.

Details of a three-roller system is shown in FIG. 3 and such three-roller system can be used in conjunction with, for example, a conventional draw frame substantially in the manner as illustrated in FIG. 1 for carrying out the first exemplary embodiment of the inventive method. The rollers 21, 22 and 23 are provided with internal electrical heating coils and with electrical leads for connection with a power source. Heating of the electrical resistance elements results in a predetermined surface temperature of the rollers 21, 22 and 23 and such surface temperature may be automatically maintained within a narrow range by means of a thermostat. The heatable rollers 21, 22 and 23 are followed by a first pair of rollers of which 24 and 25, are shown.

Figure 4:
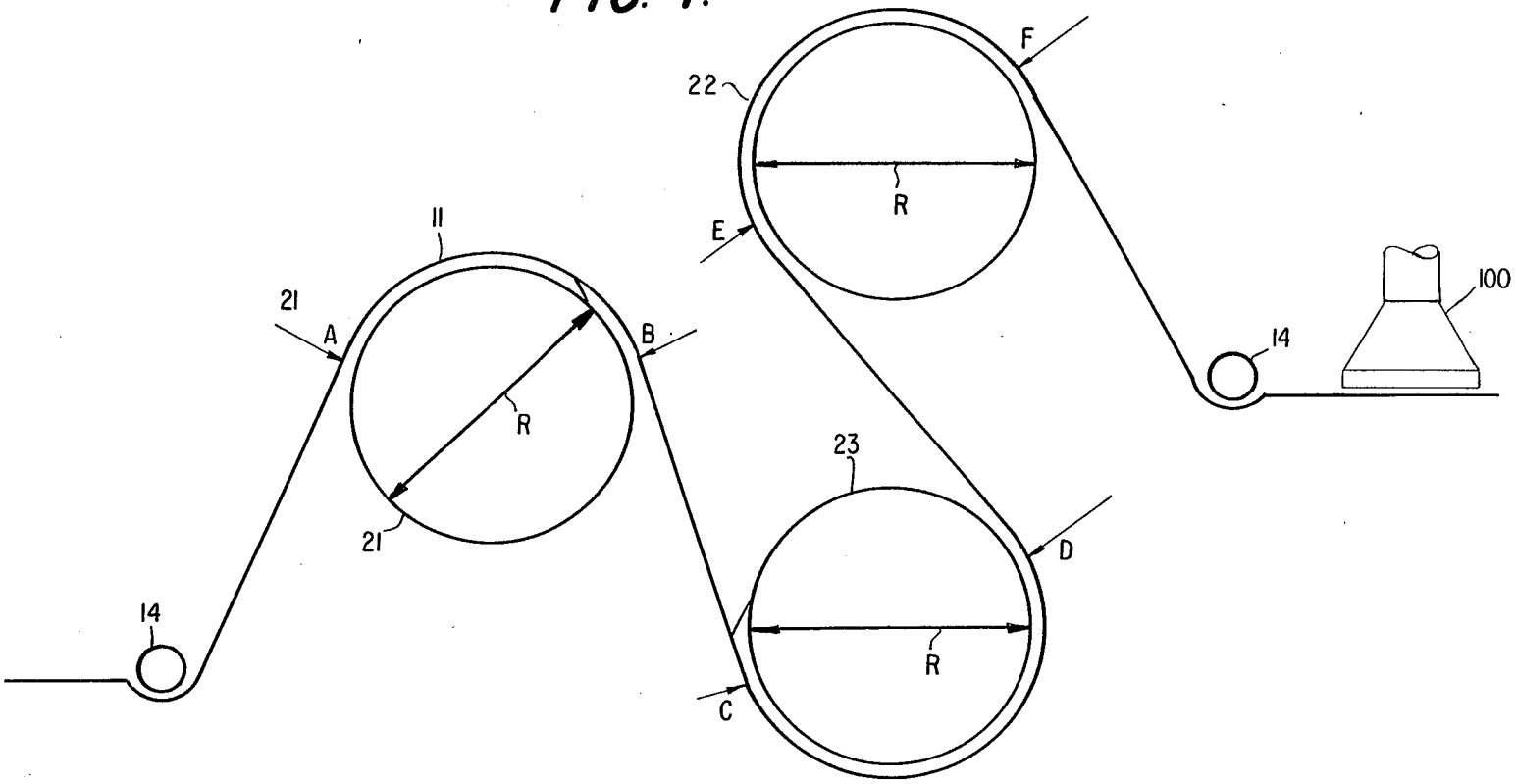
FIG. 4 illustrates constructional details of the three-roller system as shown in FIG. 2.

The dimensions of the heatable rollers 21, 22 and 23, and the configuration of these rollers are shown in detail in FIG. 4. The heatable rollers 21, 22 and 23 have each a diameter of 85 mm and the distance between the surfaces of these rollers is 30 mm. The total length of contact from the points A to B, plus C to D and plus E to F, of the heatable rollers 21, 22 and 23 with the cotton sliver 11 moving in the direction designated by the reference character M, is about 55 cm. Heating of the cotton sliver 11 to a minimum temperature of 70° C. at a velocity of 30 m/sec renders the adhering honeydew droplets brittle and hard. When the cotton sliver 11 is moved at a higher velocity there must be used a higher surface temperature and/or a longer path of contact with the heated surfaces.

The further processing of the cotton slivers does not cause any problems. The hard droplets are subsequently crushed to powder or to small particles, and can be sucked off as exemplified by the suction device 100 constituting one possible form of separating means for the hard honeydew droplets. No adverse effect was observed as regards cotton quality or color. It is generally advisable to allow the cotton to attain equilibrium with ambient humidity before further processing.

It should be clear that the aforedescribed rollers also may be heated using hot air or hot liquid and that any combination of heat conduction, convection and radiation may be used in the heating process.

Figure 5:
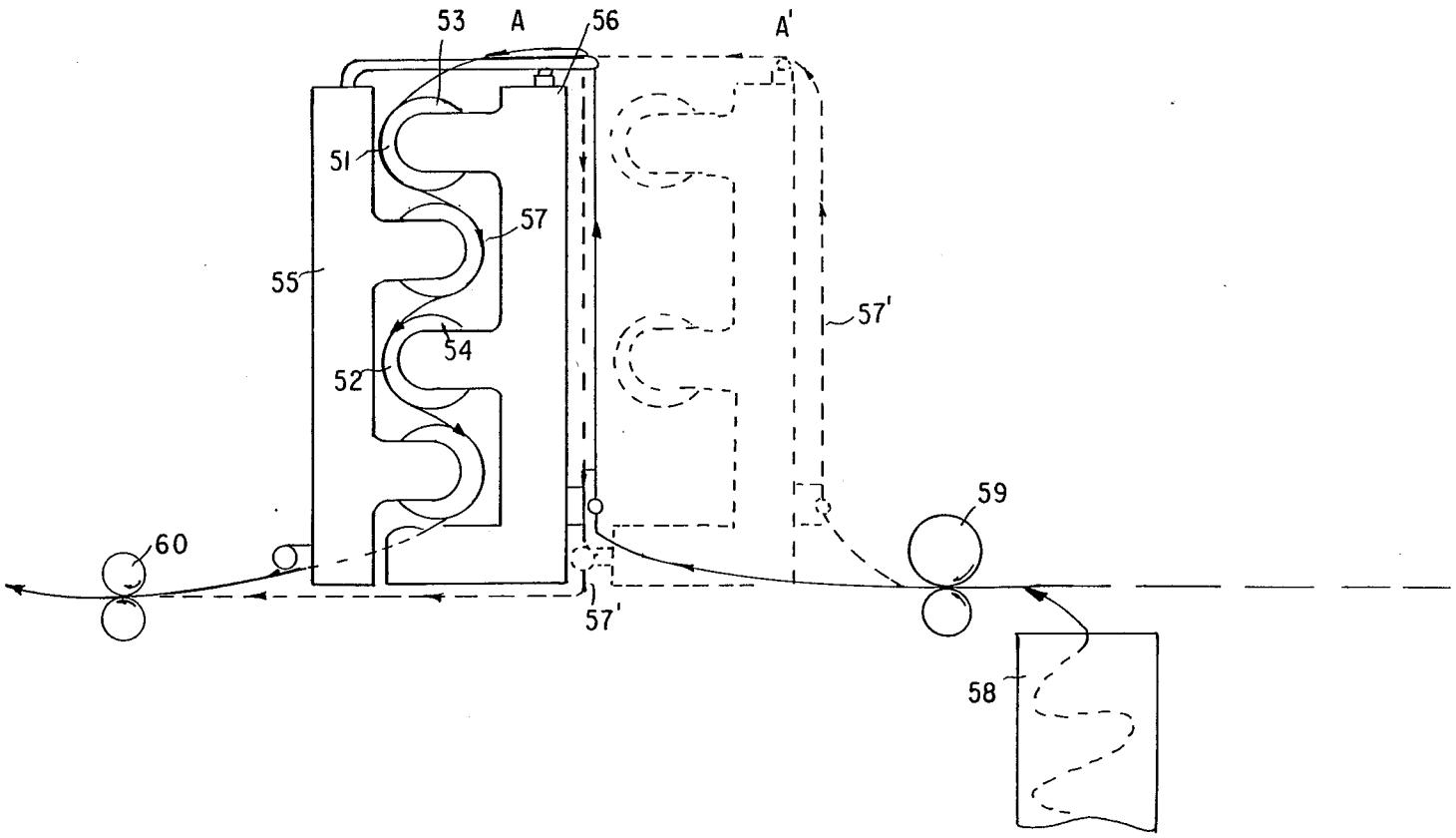
FIG. 5 is an elevational sectional view of a further roller system for carrying out the first exemplary embodiment of the inventive method for processing cotton fiber sliver.

As shown in FIG. 5, there is provided a further roller system for carrying out the first exemplary embodiment of the inventive method. Specifically, the roller system comprises four heatable rollers 51, 52, 53 and 54, each of which is provided with a heating element (not shown) which maintains a predetermined and preselected surface temperature at the rollers 51, 52, 53 and 54 during operation. As shown, the system comprises a support frame 55 on which there are mounted the heatable rollers 53 and 54, whereas the rollers 51 and 52 are mounted on a movable frame 56.

When the movable frame 56 is in the position indicated by the reference character A, the cotton sliver 57, from container 58, passes essentially in contact with half the circumference of each one of the rollers 51 to 54, as shown in FIG. 5, and through roller pairs 59 and 60, which are synchronized with the heatable other rollers 51 to 54. In this arrangement the cotton sliver 57 takes the configuration shown by the full line. When for any reason the process is to be interrupted, for example, in order to prevent overheating, the movable frame 56 is moved towards the right into the position indicated by dashed lines and the reference character A'. The cotton sliver, then, takes the configuration indicated by the further dashed line and such cotton sliver 57' is out of contact with any heated surface. This movement can automatically be actuated whenever the process is to be temporarily interrupted. When treatment of the cotton sliver is to be resumed, the device is actuated and the right-hand-side rollers 51 and 52 move again to the position adjacent to the left-hand rollers 53 and 54, which takes a few seconds. Only after the rollers 51 to 54 have again reached the full-line original position, the movement of the cotton sliver 57 is actuated.

It is, of course, possible to use any number of heatable rollers, from three on upwards, with at least one being located on the right-hand side or movable frame.

In the roller system shown in FIG. 5, the surface temperature of the heatable rollers 51 to 54 does not differ from the surface temperature set out in the other roller system described hereinbefore, and also the period of time during which the cotton sliver 57 is in touch or contact with the heated rollers 51 to 54 is not different.

Figure 6:
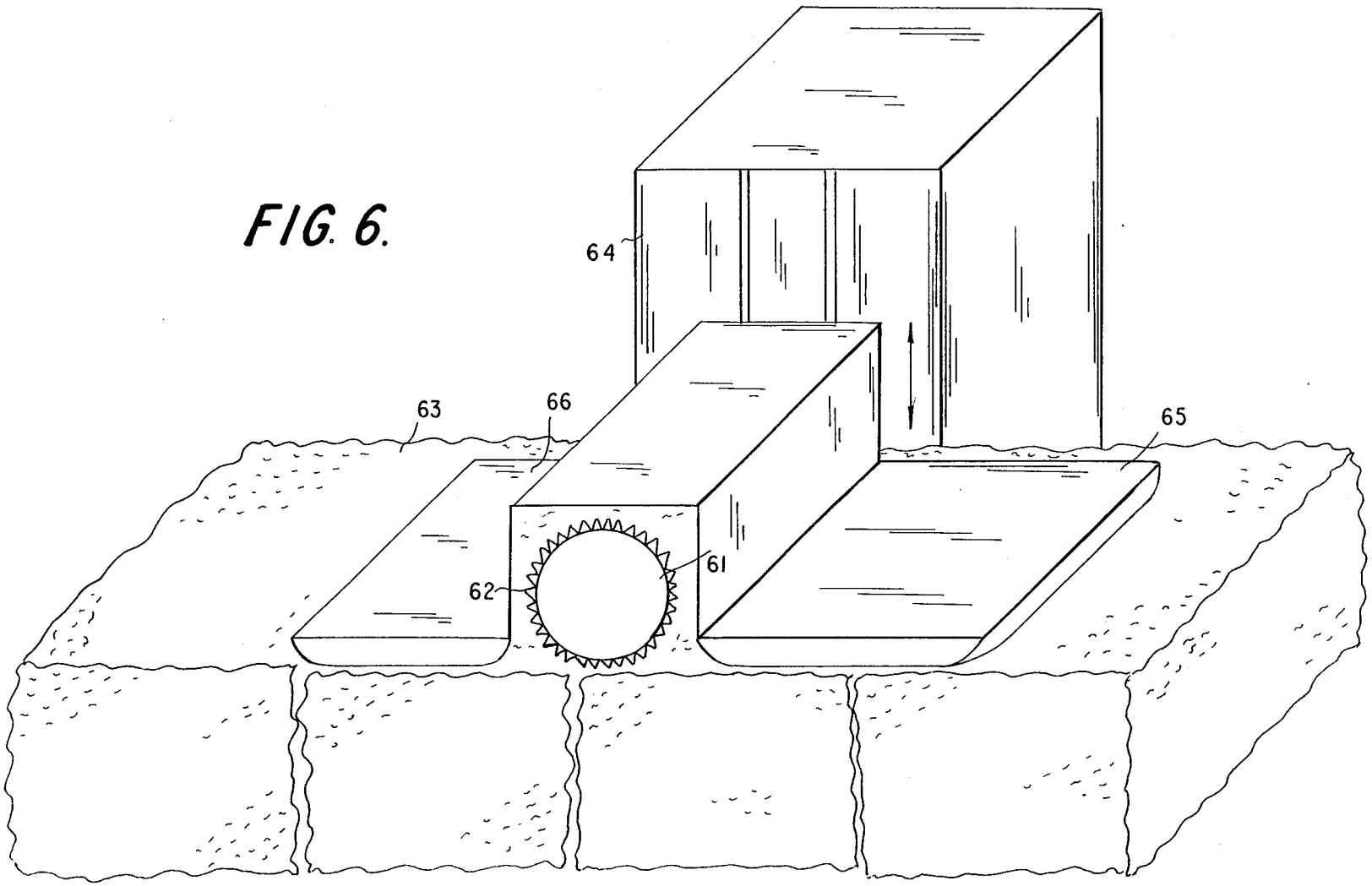
FIG. 6 is a perspective side-view of a device for carrying out a second exemplary embodiment of the inventive method for processing cotton bales.

A further system illustrated in FIG. 6 serves to carry out a second exemplary embodiment of the inventive method for processing cotton bales 63.

Raw cotton is supplied in the form of cotton bales 63, and a movable flock or tuft detaching machine is used in order to gradually remove the cotton in the form of flocks or tufts 62. The flocks or tufts 62 are removed by means of a detaching machine in the form of a wheel 61 during a plurality of passes over the cotton bales 63 which are arranged in line. Thus there is also obtained a homogenous blend from the plurality of cotton bales 63, resulting in a uniform product. The thickness of the cotton layer which is removed during each pass, can be preselected within a rather wide range. The flocks or tufts 62 are sucked or drawn away by a vacuum system (not shown) into a further stage of processing.

The wheel 61 is provided with a plurality of teeth or other structures for plucking the flocks or tufts 62 and rotates so as to remove the flocks or tufts 62 of cotton as the device passes over the bales 63 of cotton, the flock or tufts 62 being sucked by means of the vacuum system into a section 64. According to the invention, there are provided plate-like heating devices 65 and 66 containing heating means adapted to maintain the surface of the plate-like heating devices 65 and 66 in contact with the cotton at a predetermined and preselected temperature as the device moves over the cotton bales 63. When the device moves from left to right, the plate-like heating device 65 is heated, and when the movement is in the opposite direction, the plate-like heating device 66 is heated. The contact of the plate-like heating devices 65 and 66 with the upper layer of the cotton bales 63 is such that it renders the honeydew particles or droplets brittle and hard.

Advantageously, both the plate-like heating devices 65 and 66 are heated to the treatment surface temperature during passage of the flock or tuft detaching machine over the cotton bales 63.

The illustrated flock or tuft detaching machine containing the plate-like heating devices 65 and 66 may be used in addition to the aforedescribed heated-roller devices or may be used, to a large extent, instead of the aforedescribed heated-roller devices.

It should be clear that the inventive method can be effected before the blending of the cotton slivers to a single cotton sliver on a draw frame like, for example, the conventional draw frame 17. However, the inventive method may also be brought into effect at any preceding stage of the processing of the cotton.

It should also be clear that the heating can be effected after ginning, at the ginning stage, at the spinning mill, or any other desired cotton processing stage, particularly to a temperature of above 70° C. by using various heating means such as, for example, hot air, IR heating or the like, as set out above. In fact, the inventive method is intended to encompass any steps adequate to heat-treat cotton or cotton fibers before or during processing at the spinning mill. This heat treatment results in converting or transforming the adhesive sticky honeydew droplets into a hard and brittle form. The devices for heating the upper surfaces of cotton bales can also be provided as separate entities, to be used in conjunction with flock or tuft detaching machines. The hard and brittle droplets are generally crushed to small particles or powder as the cotton slivers pass through the draw frames, or they can be passed through a pair of crushing rollers. Such particles and powder is advantageously removed by a vacuum suction system.

It is clear that various changes and modifications of devices suitable for such heating can be resorted to without departing from the scope and spirit of the present invention.

While there are shown and described present preferred embodiments of the invention, it is to be distinctly understood that the invention is not limited thereto, but may be otherwise variously embodied and practiced within the scope of the following claims.

What we claim is:

1. A method of processing cotton, comprising the steps of:

exposing the cotton to a heat source having a predeterminate temperature;

during said step of exposing the cotton to said heat source having said predeterminate temperature, heating the cotton to a preselected maximum temperature;

said step of heating the cotton to said preselected maximum temperature, entailing the step of exposing the cotton to said heat source having said predeterminate temperature, for a predetermined period of time sufficient for heating the cotton to said preselected maximum temperature and thereby transforming honeydew, which is adhered to the cotton, to a hard and brittly, readily removable material; and carrying out said exposing and heating operations in combination with selective ones of conventional seed cotton and cotton processing operations.

2. The method according to claim 1, wherein:

said step of carrying out said exposing and heating operations in combination with selective conventional seed cotton and cotton processing operations entails carrying out said exposing and heating operations in conjunction with at least the operation of ginning seed cotton.

3. The method according to claim 1, wherein:

said step of heating the cotton to said preselected maximum temperature entails heating the cotton to a temperature op to 140° C.

4. The method according to claim 3, wherein said step of heating the cotton to said preselected maximum temperature up to 140° C. entails heating the cotton to a preselected maximum temperature between 70° C. and 140° C.

5. The method according to claim 1, wherein:

said step of exposing the cotton to said heat source having said predeterminate temperature and for said predetermined period of time, entails exposing the cotton to said heat source having said predeterminate temperature, for an increasing predetermined period of time with an increase in the preselected maximum temperature to which the cotton is heated.

6. The method according to claim 5, wherein said step of exposing the cotton to said heat source having said predeterminate temperature for said increasing predetermined period of time, entails exposing the cotton for an increasing period of time in the range of about half a second to about 10 seconds for an increase in said preselected maximum temperature from 70° C. to 140° C.

7. The method according to claim 1, wherein:

said step of exposing the cotton to said heat source having said predeterminate temperature and for said predeterminate period of time which is insufficient for producing a discoloration of the cotton to which said honeydew is adhered.

8. The method according to claim 1, wherein:

said step of heating the cotton to said preselected maximum temperature entails transferring heat from said heat source to the cotton by heat conduction.

9. The method according to claim 1, wherein:

said step of heating the cotton to said preselected maximum temperature entails transferring heart from said heat source to the cotton by convection.

10. The method according to claim 1, wherein:

said step of heating the cotton to said preselected maximum temperature entails transferring heat from said heat source to the cotton by radiation.

11. A method of processing cotton, comprising the steps of:

exposing the cotton to a heat source having a predeterminate temperature;

during said step of exposing the cotton to said heat source having said predeterminate temperature, heating the cotton to a preselected maximum temperature;

said step of heating the cotton to said preselected maximum temperature, entailing the step of exposing the cotton to said heat source having said predeterminate temperature, for a predetermined period of time sufficient for heating the cotton to said preselected maximum temperature and thereby transforming honeydew, which is adhered to the cotton, to a hard and brittle, readily removable material;

selecting, as said heat source, at least one heatable body possessing at least one heating surface;

heating said at least one heatable body and thereby said at least one heating surface to said predeterminate temperature;

moving the cotton relative to and in contact with said at least one heating surface of said at least one heatable body and thereby transferring heat from said heating surface to the cotton in order to heat the cotton to said preselected maximum temperature;

said step of selecting said at least one heatable body as said heat source entails selecting, as said at least one heatable body, at least one rotatable and heatable roller defining at least one circumferential roller surface as said heating surface;

said step of heating said at least one heating surface entails internally heating said at least one roller and thereby heating said at least one circumferential roller surface to said predeterminate temperature; and said step of moving the cotton relative to and in contact with said at least one heating surface of said at least one heatable body entails passing the cotton over and in contact with a predetermined portion of said at least one circumferential roller surface, which is heated to said predeterminate temperature.

12. The method according to claim 11, wherein:

said step of internally heating said at least one circumferential roller surface by internally heating said at least one roller includes heating said at least one roller by means of a heated heat carrier fluid.

13. A method of processing cotton, comprising the steps of:

exposing the cotton to a heat source having a predeterminate temperature;

during said step of exposing the cotton to said heat source having said predeterminate temperature, heating the cotton to a preselected maximum temperature;

said step of heating the cotton to said preselected maximum temperature, entailing the step of exposing the cotton to said heat source having said predeterminate temperature, for a predetermined period of time sufficient for heating he cotton to said preselected maximum temperature and thereby transforming honeydew, which is adhered to the cotton, to a hard and brittle, readily removable material; and using, as the cotton, cotton sliver during said exposing and heating steps.

14. The method according to claim 13, wherein:

said step of heating the cotton to said preselected maximum temperature entails heating said cotton sliver to a preselected maximum temperature in the range of 70° C. to 140° C.; and said step of heating the cotton to said preselected maximum temperature entailing the step of exposing said cotton sliver to said heat source having said predeterminate temperature, for an increasing period of time in the range of about half a second to about five seconds with an increase in said preselected maximum temperature from 70° C. to about 140° C.

15. A method of processing cotton, comprising the steps of:

exposing the cotton to a heat source having a predetermined temperature;

during said step of exposing the cotton to said heat source having said predeterminate temperature, heating the cotton to a preselected maximum temperature;

said step of heating the cotton to said preselected maximum temperature, entailing the step of exposing the cotton to said heat source having said predetermined temperature, for a predetermined period of time sufficient for heating the cotton to said preselected maximum temperature and thereby transforming honeydew, which is adhered to the cotton, to a hard and brittle, readily removable material;

selecting, as said heat source, at least one heatable body possessing at least one heating surface;

heating said at least one heatable body and thereby said at least one heating surface to said predeterminate temperature;

moving the cotton relative to and in contact with said at least one heating surface of said at least one heatable body and thereby transferring heat from said heating surface to the cotton in order to heat the cotton to said preselected maximum temperature;

using, as the cotton, at least one cotton bale during said exposing and heating operations;

placing, as said at least one heatable body possessing said at least one heating surface, an internally heatable plate-like heating device having said at least one heating surface into contact with an upper layer of said at least one cotton bale;

said step of heating said at least one heatable body entailing the step of internally heating said internally heatable plate-like heating device and thereby said at least one heating surface to said predeterminate temperature; and said step of moving the cotton relative to and in contact with said at least one heating surface entailing the step of moving said plate-like heating device relative to and in contact with said upper layer of said at least one cotton bale in order to heat said upper layer of said at least one cotton bale to said preselected maximum temperature.

16. The method according to claim 15, further including the step of:

removing said upper layer from said at least one cotton bale after said step of heating said upper layer of said at least one cotton bale to said preselected maximum temperature.

17. The method according to claim 16, further including the step of:

placing a travelling flock detaching means on said upper layer of said at least one cotton bale;

connecting said at least one internally heatable plate-like heating device possessing said at least one heating surface, at least to an upstream side of said travelling flock detaching means as viewed in the travel direction of said travelling flock detaching means.

18. A method of processing cotton, comprising the steps of:

exposing the cotton to a heat source having a predeterminate temperature;

during said step of exposing the cotton to said heat source having said predeterminate temperature, heating the cotton to a preselected maximum temperature;

said step of heating the cotton to said preselected maximum temperature, entailing the step of exposing the cotton to said heat source having said predeterminate temperature, for a predetermined period of time sufficient for heating the cotton to said preselected maximum temperature and thereby transforming honeydew, which is adhered to the cotton, to a hard and brittle, readily removable material; and at least partially separating from the heated cotton the hard and brittle material.

19. The method according to claim 18, wherein:

said step of at least partially separating said hard and brittle material from said heated cotton entails the steps of:

crushing said hard and brittle material by passing the cotton, after heating to said preselected maximum temperature, between at least one pair of rollers; and thereafter applying suction to the cotton and thereby at least partially removing said crushed hard and brittle material from the cotton.

20. The method according to claim 19, further including the steps of:

using the cotton in the form of cotton sliver;

said steps of exposing and heating the cotton entailing the steps of exposing and heating said cotton sliver for transforming said honeydew which is adhered to said cotton sliver, into said hard and brittle material; and said step of crushing said hard and brittle material entails passing said cotton sliver, after heating said cotton sliver to said preselected maximum temperature, through the rollers of a drawing frame.

21. A method of processing cotton, comprising the steps of:

exposing the cotton to a heat source having a predeterminate temperature;

during said step of exposing the cotton to said heat source having said predeterminate temperature, heating the cotton to a preselected maximum temperature;

said step of heating the cotton to said preselected maximum temperature, entailing the step of exposing the cotton to said heat source having said predeterminate temperature, for a predetermined period of time sufficient for heating the cotton to said preselected maximum temperature and thereby transforming honeydew, which is adhered to the cotton, to a hard brittle, readily removable material;

at least partially separating from the heated cotton the hard and brittle material; and said step of heating said cotton, after ginning, to said preselected maximum temperature, entails heating the cotton to a preselected maximum temperature between 70° and 100° C.

22. A method of processing cotton, comprising the steps of:

exposing the cotton to a heat source having a predeterminate temperature;

during said step of exposing the cotton to said heat source having said predeterminate temperature, heating the cotton to a preselected maximum temperature;

said step of heating the cotton to said preselected maximum temperature, entailing the step of exposing the cotton to said heat source having said predeterminate temperature, for a predetermined period of time sufficient for heating the cotton to said preselected maximum temperature and thereby transforming honeydew, which is adhered to the cotton, to a hard and brittle, readily removable material;

selecting, as said heat source, at least one heatable body possessing at least one heating surface;

heating said at least one heatable body and thereby said at least one heating surface to said predeterminate temperature; and moving the cotton relative to and in contact with said at least one heating surface of said at least one heatable body and thereby transferring heat from said heating surface to the cotton in order to heat the cotton to said preselected maximum temperature.

* * * * *

UNITED STATES PATENT AND TRADEMARK OFFICE

CERTIFICATE OF CORRECTION

PATENT NO. : 4,888,856

DATED : December 26, 1989

INVENTOR(S) : HERZEL BAR YECHESKEL et al

It is certified that error appears in the above-identified patent and that said Letters Patent is hereby corrected as shown below:

Column 7, line 4, after "and" please delete "brittly" and replace with --brittle--

Column 7, line 45, after "time" please insert --, entails selecting a predetermined period of time--

Column 9, line 18, before "temperature" please delete "determined" and insert --determinate--

Signed and Sealed this

Nineteenth Day of March, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,888,856

DATED : December 26, 1989

INVENTOR(S) : Herzel Bar Yecheskel, et al

It is certified that error appears in the above-identified patent and that said Letters Patent is hereby corrected as shown below:

Column 7, line 4, after "and" please delete "brittly" and replace with --brittle--

Column 7, line 45, after "time" please insert --, entails selecting a predetermined period of time--

Column 9, line 18, before "temperature" please delete "determined" and insert --determinate--

Signed and Sealed this

Twenty-seventh Day of August, 1991

*Attest:*

*Attesting Officer*

HARRY F. MANBECK, JR.

*Commissioner of Patents and Trademarks*